United States Patent [19]

Isackson

[11] Patent Number: 4,463,506

[45] Date of Patent: Aug. 7, 1984

[54] TAPS FOR DANCING

[76] Inventor: Dale F. Isackson, Box 93, West Star Rte., Two Harbors, Minn. 55616

[21] Appl. No.: 451,245

[22] Filed: Dec. 20, 1982

[51] Int. Cl.[3] ..... A43B 3/00

[52] U.S. Cl. ..... 36/113; 36/8.3; 36/114; 36/136; 36/139

[58] Field of Search ..... 36/113, 114, 8.3, 136, 36/139

[56] References Cited

U.S. PATENT DOCUMENTS

| | | | |
|---|---|---|---|
| 1,997,221 | 3/1935 | Landi | 36/8.3 |
| 2,011,435 | 8/1935 | Capezio | 36/8.3 |
| 2,059,952 | 11/1936 | Landi | 36/8.3 |
| 2,124,908 | 7/1938 | Capezio | 36/8.3 |
| 2,168,303 | 8/1939 | Sothen | 73/224 |
| 2,173,599 | 4/1939 | Sothen | 36/8.3 |
| 2,443,727 | 6/1948 | Mont et al. | 36/8.3 |
| 2,479,428 | 8/1949 | Sunseri | 36/8.3 |
| 2,739,394 | 3/1956 | Morgan | 36/8.3 |
| 2,754,598 | 7/1956 | Aull | 36/8.3 |
| 3,052,995 | 9/1962 | Merkle | 36/8.3 |

*Primary Examiner*—Werner H. Schroeder
*Assistant Examiner*—Mary A. Ellis

[57] ABSTRACT

Apparatus is disclosed for attachment to shoes to create tap dancing shoes, including heel and toe attachments. Each of the attachments has two pieces, one of which is fixedly attached to the shoe along respective outer edges, having a center cutout with a bridging member proximate one end. The second piece loosely fits within the center cutout of the first piece, and has a pair of projecting ears which loosely nest within cross axis grooves in the first piece, the second piece also having a forward lip and surface for contacting against the bridging member of the first piece for creating a tapping sound.

10 Claims, 11 Drawing Figures

TAPS FOR DANCING

BACKGROUND OF THE INVENTION

The present invention relates to attachment pieces for shoes to create tap dancing shoes for producing a clattering rhythm beat while dancing. More specifically, the invention relates to an improved construction for tap dancing attachment pieces, wherein a more pleasing rhythm sound may be achieved than has heretofore been possible.

A number of different designs have been utilized in the construction of attachment pieces for shoes, for the purpose of creating tap dancing shoes. For example, U.S. Pat. No. 2,443,727, issued June 22, 1948, discloses a two-piece attachment wherein one piece is fixedly attached to a shoe and a second piece is seated within the first piece, and has a threadable screw adjustment for controlling the relative looseness of the seating arrangement. The contacting of the second piece against the first piece creates the necessary tapping sound. U.S. Pat. No. 2,739;394, issued Mar. 27, 1956 discloses a two-piece attachment for a shoe wherein one piece is fixedly attached to the shoe and the second piece is pivotally secured to the first piece adjacent one end thereof. When the shoe is lifted the pivotal member drops away from its seated position within the first piece, and when the shoe contacts the floor the second piece is pivotally forced against the first piece to create the necessary sound. Both of these patents require construction intricacies which are generally unsatisfactory for attachment to shoes, and produce generally unsatisfactory sound effects. Further, the attachment described in Morgan is downwardly pivotal away from the shoe and from the other attachment piece, and is subject to catching on any raised edge which might be contacted by the shoe. Such contact would severely damage or misalign the attachment pieces and render the shoe unusable for dancing.

In most tap dancing shoe attachments it is necessary to provide at least one attachment piece which is fixedly attached to the shoe itself. Further, it is desirable to provide a second attachment piece which relatively freely floats, so that when the shoe is raised from the floor the attachment piece becomes spaced away from its contact point against the first piece or against the shoe. When the shoe is brought into contact with the floor it is desirable that the second attachment piece firmly and consistently contact an impact point without delay so as to enable the dancer to reliably produce the sound effects desired. Further, it is desirable to construct these attachment pieces in a manner which tends to amplify the sound created upon contact, by providing some sort of hollow chamber for permitting a sound resonance to occur.

Since dancing shoe attachments necessarily are placed on the bottom of shoes they undergo considerable stress and wear during use. It is therefore necessary that these attachments be constructed simply and reliably, with a minimum of complex mechanical attachment and interaction. The attachments should not vary in their sound producing effects over long periods of use and wear, and the sound tones produced should remain relatively consistent. Further, the attachments should not be constructed of heavy or bulky material, but should be made as lightweight as possible, and as close to conformity with the surfaces of the bottom of the shoe as is possible.

It is a principal object of the present invention to provide attachments for dancing shoes which reliably produce the same tonal effects over long periods of use. It is a further object of the present invention to provide dancing shoe attachments which are lightweight and which conform to the bottom shoe surface, without producing any dangerous projections for catching against edges on any floor or other surface.

It is yet another object of the present invention to provide dancing shoe attachment pieces which have a simple and reliable mechanical interaction, and which provide a clear and concise tapping sound effect each time the shoe is brought into contact with a floor surface. It is yet another object of the present invention to provide a tonal sound effect which is produced and amplified by a resonance created at the impact point between two metallic pieces, the noise produced thereby being created by a resonance produced by the novel construction of the invention.

The foregoing and other objects will become apparent from the following specification and claims, and with reference to the attached drawings.

SUMMARY OF THE INVENTION

The invention comprises a pair of attachment pieces, one of which is rigidly attached to the bottom surface of a shoe by means of screws or other fasteners. This first piece has a center axial cutout with a bridging member proximate one end, and a pair of cross-axis grooves cut into the spaced-apart edges. A second attachment piece loosely fits within the center cutout of the first attachment piece, and has a pair of projecting ears which loosely seat in the cross-axis grooves of the first piece. The second attachment piece also has an increased mass along its forward edge, and is positioned so as to contact the bridging member of the first piece proximate the forward mass. Both attachment pieces are curved in the axial and the off axis directions to conform generally with the bottom surface of the shoe, and to present a smoothly curved outer surface for contacting the floor.

DESCRIPTION OF THE PREFERRED EMBODIMENT

Figure 1:
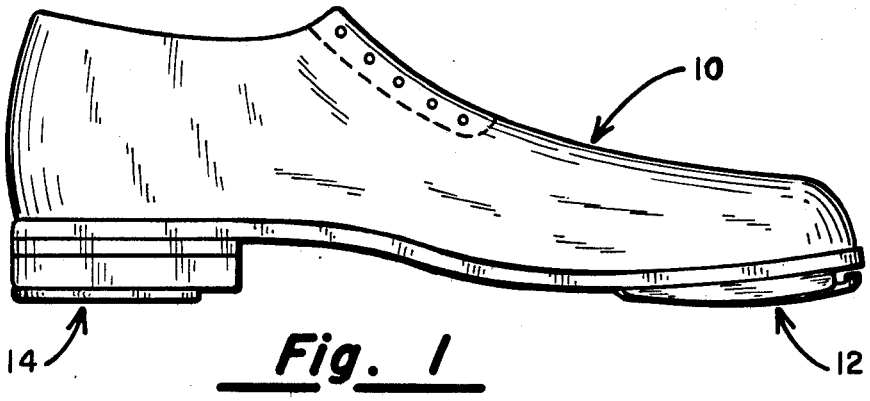
FIG. 1 shows a side elevation view of a dancing shoe having the invention attached thereto.
Figure 2:
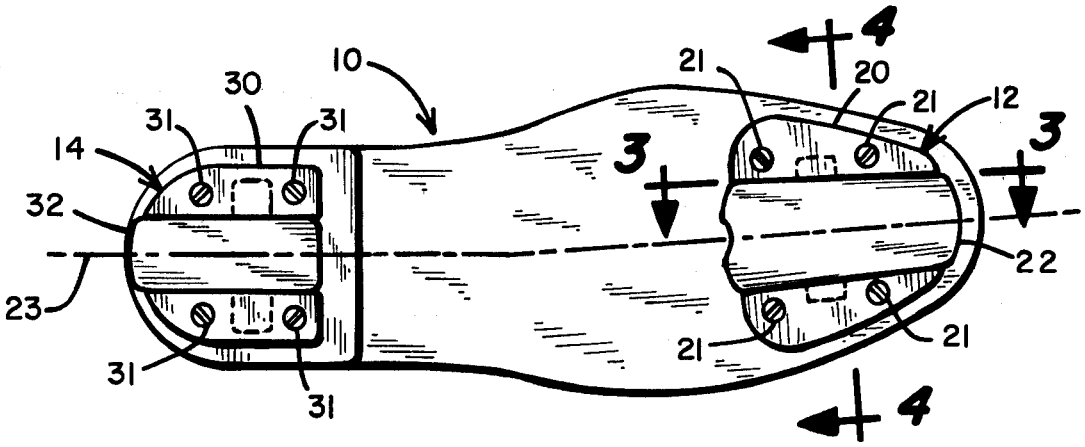
FIG. 2 shows a bottom view of the shoe of FIG. 1.

Referring first to FIG. 1, there is shown a dancing shoe 10 in elevation view, having two different constructions of the invention attached thereto. A pair of toe attachment pieces 12 are shown fixedly attached to the shoe proximate the toe of the shoe, and a pair of heel attachment pieces 14 are shown fixedly attached to the shoe on the heel of the shoe. FIG. 2 shows a bottom view of shoe 10 with attachment pieces 12 and 14 rigidly affixed thereto. Attachment pieces 12 include a toepiece 20 which is attached to the sole of shoe 10 by means of screws or other fasteners 21. Toe insert 22 is loosely fitted in conjunction with toepiece 21, in a manner to be hereinafter described. Heelpiece 30 is fixedly attached to the heel of shoe 10 by means of screws or other fasteners 31. Heel insert 32 is loosely fitted in conjunction with heelpiece 30 in a manner to be hereinafter described. The fit and engagement between toepiece 20 and toe insert 22 is functionally equivalent to the corresponding fitting engagement between heelpiece 30 and heelpiece 32. Toe attachment pieces 12 in all respects operate in a manner equivalent to heel attachment pieces 14, and therefore a detailed description of such construction will be provided herein only with respect to toe attachment pieces 12. The differences which exist between toe attachment pieces 12 and heel attachment pieces 14 are merely differences required for adaptation to the different structural surfaces of the toe of shoe 10 versus the heel of shoe 10. In all other respects the functions of these attachment pieces are identical.

Figure 3A:
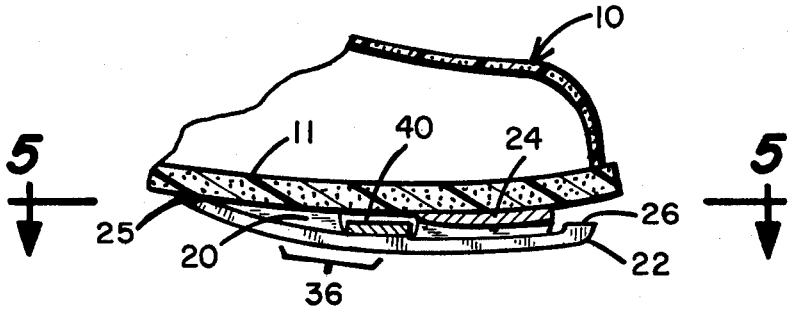
FIG. 3A shows a side view taken along the lines 3—3 of FIG. 2, with the invention in a first operating position.

FIG. 3A shows a cross-sectional view taken along the lines 3—3 of FIG. 2, showing the relative position of toepiece 20 and toe insert 22 in a first operative position. The operative position shown in fIG. 3A corresponds to the condition when the toe of dancing shoe 10 is raised away from a floor surface. In this position, the front lip 26 of toe insert 22 is spaced away from the bottom surface of sole 11. This spacing is controlled by ears 40 and 42 resting upon channel 28 (FIG. 5), while rear edges 25 engages against the undersurface of sole 11. Correspondingly, the rear edge 25 of toe insert 22 is in contact with the lower surface of sole 11. Edge 25 is shaped so as to present a flat surface in engagement against sole 11.

Figure 5:
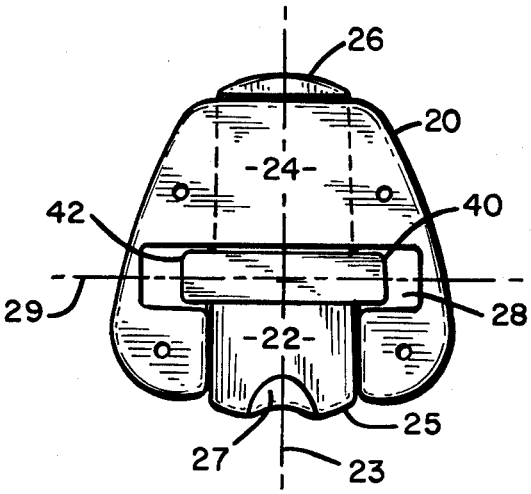
FIG. 5 shows a view taken along the lines 5—5 of FIG. 3A.

FIG. 5 shows a view taken along the lines 5—5 of FIG. 3A, wherein the engagement between toepiece 20 and toe insert 22 is more clearly illustrated. Toepiece 20 is constructed symmetrical about an axis 23, which is aligned along the center of shoe 10. A groove or channel 28 is cut into toepiece 20 along an axis 29 which is normal to axis 23. Channel 28 is preferably cut deeper proximate axis 23, and shallower proximate the outer edges of toepiece 20. An ear 40 is formed on toe insert 22, to loosely fit within channel 28 on one side of toepiece 20, and an ear 42 is formed on insert 22 to loosely fit within channel 28 on the other side of toepiece 20. Front lip 26 projects forwardly of the front edge of toepiece 20, and bridging member 24 joins together the respective right and left edges of toepiece 20. The center portion 27 of rear edge 25 is preferably cut away in order to provide more comfort to the user, by providing a surface engagement with sole 11 which conforms to the shape of sole 11 more closely.

Figure 6A:
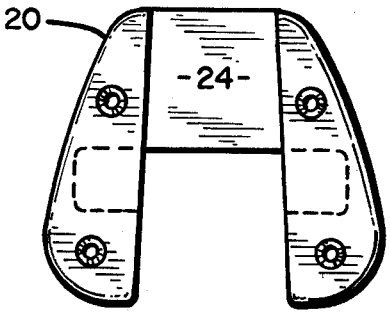
FIG. 6A shows a bottom view of one of the attachment pieces of the invention.
Figure 6B:
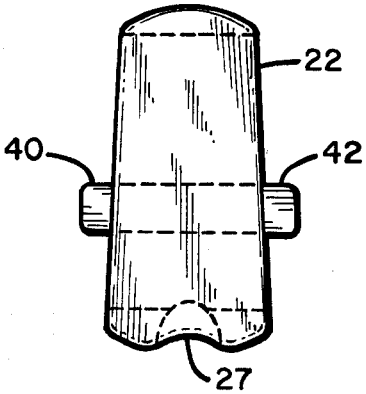
FIG. 6B shows a bottom view of a second attachment piece of the invention.

FIG. 6A shows a bottom view of toepiece 20. Bridging member 24 is formed along a recessed surface between the respective sides of toepiece 20. The recess formed by bridging member 24 provides an improved operative engagement of toe insert 22 with toepiece 20. FIG. 6B shows a bottom view of toe insert 22.

Figure 3B:
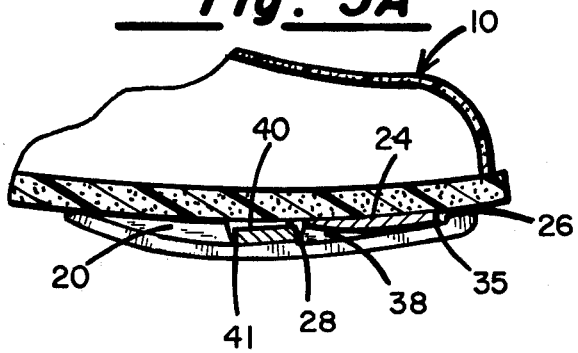
FIG. 3B shows a side view taken along the lines 3—3 of FIG. 2, with the invention in a second operational position.

FIG. 3B shows a cross-sectional view taken along the lines 3—3 of FIG. 2, wherein toepiece 20 and toe insert 22 are engaged in a position corresponding to the position when shoe 10 is in contact with a floor surface. In this position, a line contact is formed along line 35, wherein the front edge of bridging member 24 contacts the inner surface of toe insert 22 adjacent the rear edge of lip 26. In such position, the sharp mechanical contact along 35 produces a resonant tonal effect of the type desired. This tonal effect is created and enhanced by the construction which will be hereinafter described. Ear 40, as well as ear 42, is constructed in generally triangular cross section. The lower rear corner of ear 40 has a triangular point 41, which serves as a pivot point for engaging against the surface of channel 28. When shoe 10 is brought into contact with a floor surface, the lower surface of toe insert 22 first contacts the floor surface. The contact surface over which toe insert 22 typically contacts the floor is over the surface range 36, as illustrated in FIGS. 3A and 3B. This occurs when contact is made while the shoe is generally in a plane parallel to the floor. If the shoe is angled downwardly toward the floor the contact point is generally forward of surface range 36. The contact with a floor surface causes toe insert 22 to raise upwardly toward toepiece 20. The respective lower triangular corners of ears 40 and 42, i.e. corner 41 of ear 40, lift away from contact with channel 28, and ears 40 and 42 float within channel 28. Toe insert 22 pivots upwardly about the line of contact of edge 25 against sole 11. This results in the front lip 26 of toe insert 22 to sharply move toward toepiece 20. However, front lip 26 is sized so as to cause a line contact along line 35 between toe insert 22 and toepiece 20. As has hereinbefore been described, this line contact causes a sharp resonant sound which produces the desired tapping effect. This resonant sound is produced by the unsupported length of insert 22 between rear edge 25 and front lip 26, and is enhanced by chamber 38, which is formed between toepiece 20 and toe insert 22 when they are brought together as described. Lip 26 is sized so as to be spaced away from contact with the lower surface of sole 11, even when the toepiece 20 and toe insert 22 are brought together, but the relatively heavy mass of lip 26 causes a lower tonal effect than has heretofore been possible with other and previous taps.

Figure 4:
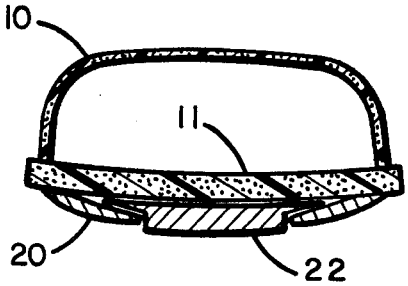
FIG. 4 shows a cross section view taken along the lines 4—4 of FIG. 2.

FIG. 4 shows a cross section view taken along the lines 4—4 of FIG. 2 FIG. 4 illustrates the relatively loose fit between toe insert 22 and toepiece 20, which permits relative freedom of movement of toe insert 22. FIG. 4 also indicates the generally rounded surface shape of toepiece 20 and toe insert 22.

Figure 7A:
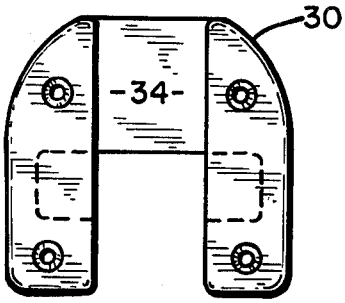
FIG. 7A shows a bottom view of one of the attachment pieces in a further construction.
Figure 7B:
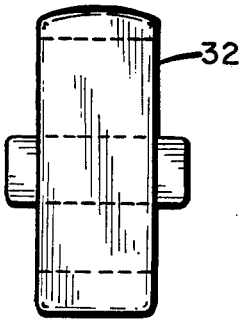
FIG. 7B shows a bottom view of a second attachment piece in a further construction.
Figure 7C:
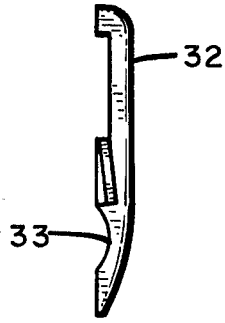
FIG. 7C shows a side view of the attachment piece of FIG. 7B.

FIG. 7A shows heelpiece 30, which is generally configured similar to toepiece 20. The structural differences relating to heelpiece 30 are due principally to the way in which it fits against the flat heel of the shoe. FIG. 7B shows heel insert 32 which is functionally equivalent to toe insert 22. FIG. 7C shows a side view of heel insert 32, illustrating a generally flat bottom surface to conform with the heel structure. A shallow groove 33 is formed on the inside surface of heel insert 32 in order to improve the desired pivoting motion of the heel insert in use.

In operation, a dancing shoe may be equipped with the toe attachment pieces alone, or with both the toe and heel attachment pieces in combination. The function of the respective toe and heel attachment pieces are similar, and only the operation of the toe attachment pieces will be described herein. When the toe is raised from contact with the floor toe insert 22 drops away from contact with toepiece 20, the triangular point of each of the ears resting against the bottom surface of the cross channels 28. As soon as the toe of the shoe is brought back into contact with the floor, the toe insert begins to move toward the toepiece, and the pivotal action about rear edge 25 causes a rapid pivoting motion of the toe insert. This is because the lever arm created between the floor contact point, somewhere along surface range 36, and rear edge 25 is a great deal shorter than the lever arm between rear edge 25 and front lip 26. Therefore, a small displacement across the first-named lever arm causes a larger and faster displacement across the second-named lever arm. This pivoting motion culminates when a sharp contact is made between the front edge of bridging member 24 against toe insert 22, along the line immediately behind lip 26. This wrapping metallic noise is resonated, and to some extent amplified, by the interior chamber 38 created in the space between the toe insert and toepiece. A loud tapping noise is thus produced, which may be mechanically controllable each time the shoe is brought into contact with the floor. The tapping noise produced thereby is at a lower tonal frequency than provided by prior art shoe taps because of the concentration of mass at front lip 26, which tends to lower the theresonant frequency.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An attachment for shoes to form tap dancing shoes, comprising:

(a) a shoe attachment piece adapted for fastening against said shoe, said piece having a pair of spaced-apart raised edges and a recessed member bridging between one end of said edges; said edges each having a groove respectively aligned across said spaced-apart region; and (b) an insert piece sized for loosely fitting between said spaced-apart edges said insert piece having a projecting ear on its sides for seating into each of said grooves and having a forward end seated over said recessed bridging member.

2. The apparatus of claim 1, wherein said insert piece further comprises a lip at said forward end, said lip projecting beyond said bridging member.

3. The apparatus of claim 2, wherein each of said projecting ears has a generally triangular cross section shape, one apex of said triangular shape contacting said groove.

4. The apparatus of claim 3, wherein said grooves are respectively deeper proximate said inset piece and shallower away from said insert piece.

5. The apparatus of claim 4, wherein said insert piece is curved so as to contact said bridging member only along a line contact region adjacent said lip.

6. The apparatus of claim 5, wherein said shoe attachment piece and said insert piece are of aluminum construction.

7. An attachment for fastening to a shoe along the length axis of the shoe, comprising (a) a first attachment piece adapted for fastening to said shoe, said piece having two halves in mirror image construction adapted for fastening about the length axis of said shoe, each of said halves having a raised edge portion generally parallel to said axis, and having a recessed bridging portion generally normal to said axis at a first position, and having a groove in said edge portion generally normal to said axis at a second position, said groove being cut into an opposite surface from said recess of said recessed bridging portion; and (b) an insert piece aligned along said axis between said raised edge portions, said insert piece having projecting ears positioned for seating in said grooves and having a forward end for seating in said recess of said recessed bridging portion.

8. The apparatus of claim 7, wherein said insert piece further comprises a lip at said forward end, said lip projecting beyond said bridging member.

9. The apparatus of claim 8, wherein each of said projecting ears have a generally triangular cross section shape, one apex of said triangular shape contacting said groove.

10. The apparatus of claim 9, wherein said insert piece is curved so as to contact said bridging member only along a line contact region adjacent said lip.

* * * * *